US008794310B2

(12) United States Patent
Allen et al.

(10) Patent No.: US 8,794,310 B2
(45) Date of Patent: Aug. 5, 2014

(54) SUPPORT TUBE FOR A SWELL PACKER, SWELL PACKER, METHOD OF MANUFACTURING A SWELL PACKER, AND METHOD FOR USING A SWELL PACKER

(75) Inventors: Michael Allen, Saar (BH); Frederick Lemme, Katy, TX (US); Nitin Y. Vaidya, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 313 days.

(21) Appl. No.: 12/614,018

(22) Filed: Nov. 6, 2009

(65) Prior Publication Data

US 2010/0116496 A1 May 13, 2010

Related U.S. Application Data

(60) Provisional application No. 61/113,700, filed on Nov. 12, 2008.

(51) Int. Cl.
*E21B 33/12* (2006.01)

(52) U.S. Cl.
USPC ..... 166/179

(58) Field of Classification Search
CPC ..... E21B 33/13; E21B 33/14; E21B 33/128; E21B 33/1208
USPC ..... 166/292, 118, 387, 179, 88.1, 180
See application file for complete search history.

(56) References Cited

U.S. PATENT DOCUMENTS

| | | | | |
|---|---|---|---|---|
| 4,161,319 | A | 7/1979 | Stocking | |
| 5,048,605 | A | 9/1991 | Toon | |
| 5,195,583 | A | 3/1993 | Toon | |
| 6,286,603 | B1 * | 9/2001 | Parent | 166/387 |
| 6,834,725 | B2 | 12/2004 | Whanger | |
| 7,234,533 | B2 | 6/2007 | Gambier | |
| 7,252,142 | B2 * | 8/2007 | Brezinski et al. | 166/191 |
| 7,304,098 | B2 | 12/2007 | Zhou | |
| 7,357,189 | B2 | 4/2008 | Aldaz | |
| 7,363,986 | B2 * | 4/2008 | Brezinski et al. | 166/387 |
| 7,703,539 | B2 * | 4/2010 | Levy | 166/378 |
| 7,832,490 | B2 * | 11/2010 | Willauer | 166/387 |
| 2001/0037881 | A1 | 11/2001 | Brecheisen | |
| 2005/0016740 | A1 | 1/2005 | Aldaz | |
| 2008/0185158 | A1 | 8/2008 | Chalker | |
| 2009/0229816 | A1 | 9/2009 | Lemme | |
| 2009/0242189 | A1 | 10/2009 | Vaidya | |
| 2010/0307771 | A1 * | 12/2010 | McRobb et al. | 166/387 |

FOREIGN PATENT DOCUMENTS

WO 2007150040 12/2007

* cited by examiner

*Primary Examiner* — Brad Harcourt
*Assistant Examiner* — Michael Wills, III
(74) *Attorney, Agent, or Firm* — David J. Groesbeck; Brandon S. Clark

(57) ABSTRACT

Disclosed herein is a swellable packer having a support element. A portion of the support element is substantially adjacent to the base tubular. Another portion of the support element is separated from the base tubular and a portion of the area between the support element and the base tubular is filled with the swellable material. Also disclosed herein is a sealing system including a packer as described above and a method for sealing within a wellbore using a packer as describe above.

8 Claims, 4 Drawing Sheets

SUPPORT TUBE FOR A SWELL PACKER, SWELL PACKER, METHOD OF MANUFACTURING A SWELL PACKER, AND METHOD FOR USING A SWELL PACKER

RELATED APPLICATIONS

This application claims priority to provisional application Ser. No. 61/113,700 filed on Nov. 12, 2008, the entirety of which is incorporated herein by reference.

BACKGROUND

Hydrocarbon fluids such as oil and natural gas are obtained from a subterranean geologic formation, referred to as a reservoir, by drilling a well that penetrates the hydrocarbon-bearing formation. Once a wellbore has been drilled, the well must be completed before hydrocarbons can be produced from the well. A completion involves the design, selection, and installation of equipment and materials in or around the wellbore for conveying, pumping, or controlling the production or injection of fluids. After the well has been completed, production of oil and gas can begin.

Sealing systems, such as packers, are commonly deployed in a well as completion equipment. Packers are often used to isolate portions of a wellbore from one another. For example, packers are used to seal the annulus between a tubing string and a wall (in the case of uncased or openhole) or casing (in the case of cased hole) of the wellbore, isolating the portion of the wellbore above the packer from the portion of the wellbore below the packer. Some packers maybe actuated by hydraulic pressure transmitted either through the tubing bore, annulus, or a control line. Other packers may be actuated via an electric line deployed from the surface of the wellbore. Furthermore, some packers have been used that employ elements that respond to the surrounding well fluids and swell to form a seal. Many different materials have been disclosed as capable of having this feature. Often swelling packers have a limited ability to create contact pressure between the tubular and wall of the wellbore. When a wellbore has non-uniformity and eccentricity, as often encountered in openhole wellbores, the swelling packer's ability to form contact pressure between a tubular and the wall of the wellbore may be further limited. The amount of contact pressure is a factor in the packer's ability to control the level of differential pressure between portions of the wellbore.

Because a swellable packer with a greater amount of contact pressure may be desirable it may be desirable to place the greatest amount of swellable material between the drain pipe/support tube and the open or cased hole. Generally, more material would translate to a greater maximum swell diameter. However, it may be necessary to provide internal support for the swellable material. Particularly, when the swellable material is internally supported it is more stable under high differential pressures. Thus, it is desirable to have a swellable packer that is sufficiently internally supported to be adequately stable under high differential pressures while also maintaining a large maximum swell diameter.

SUMMARY

Disclosed herein is a packer comprising: an inner element; a support element having apertures therethrough; and a sealing element; wherein a first portion of the support element is substantially directly adjacent the inner element and wherein a second portion of the support element is separated from the inner element by a portion of the sealing element.

Also disclosed herein is a method for sealing in a wellbore comprising: providing an inner element; providing a support element having apertures therethrough; and providing a sealing element; wherein a first portion of the support element is substantially directly adjacent the inner element and wherein a second portion of the support element is separated from the inner element by a portion of the sealing element.

Also disclosed herein is a sealing system for use in a subterranean wellbore, the system comprising: a tubular; and a sealing member assembly comprising: at least two rings disposed about the tubular, wherein the rings are longitudinally spaced apart from one another, and wherein a sealing member is disposed between the rings, the sealing member comprising: a support tube member disposed about the tubular, the support member comprising a plurality of holes therethrough, wherein a first portion of the support member is substantially directly adjacent the tubular and wherein a second portion of the support member is separated from the tubular; an inner swellable element disposed at least partially between the second portion of the support member and the tubular; an outer swellable element disposed about the exterior of the support member, wherein the inner and outer swellable elements are unitized with one another; and a retainer disposed at each end of the support member, wherein the retainers provide a seal between the ends of the support member and the tubular.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

As used herein a "wellbore" may be any type of well, including, but not limited to, a producing well, a non-producing well, an experimental well, and exploratory well, and the like. Wellbores may be vertical, horizontal, some angle between vertical and horizontal, diverted or non-diverted, and combinations thereof, for example a vertical well with a non-vertical component.

Figure 1:
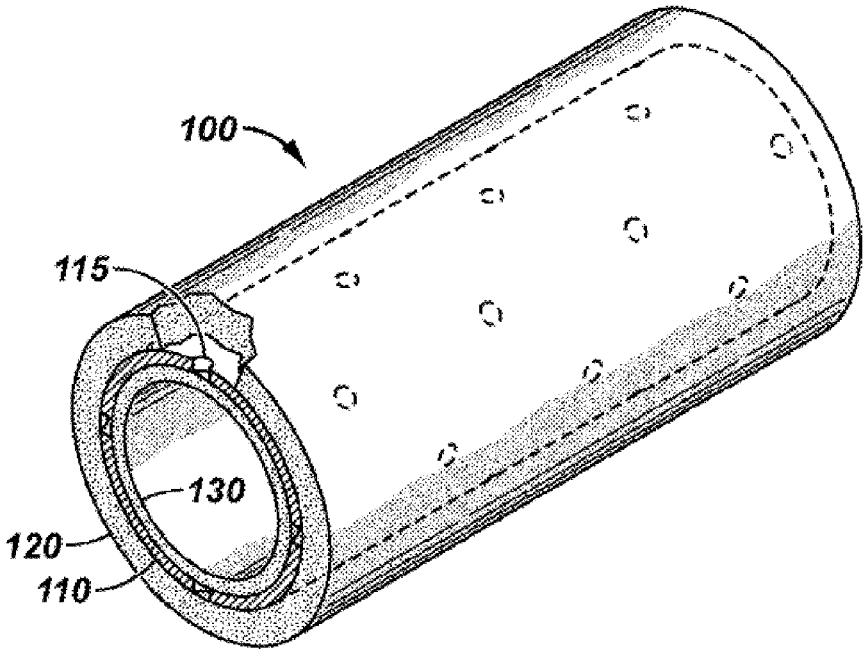
FIG. 1 is a schematic drawing of a swellable packer having in internal support tube as disclosed in U.S. Published Patent Application No. 20090229816.

FIG. 1 depicts an isometric view of a sealing member 100 as disclosed in U.S. Published Patent Application No. 20090229816, incorporated herein by reference. The sealing member 100 can include a support member 110 having an outer swellable element 120 disposed about an outer diameter thereof. The support member 110 can also have an inner swellable element 130 disposed about an inner diameter thereof. The support member 110 can have holes 115 formed therethrough allowing the outer swellable element 120 to unitize with the inner swellable element 130.

The outer swellable element 120 can be disposed about the support member 110 and can be configured to engage a wall of a wellbore or other structure disposed about the outer swellable element 120. The outer swellable element 120 can be disposed about the support member 110 by transfer molding, compression molding, or injection molding. As the outer swellable element 120 is disposed about the support member 110, the outer swellable element 120 can flow through the holes 115 and form or create the inner swellable element 130.

The inner swellable element 130 can be configured to swell within the support member 110 about a tubular or other object at least partially disposed within the support member 110. Since the outer swellable element 120 creates the inner swellable element 130, the swellable elements 120, 130 are unitized. The unitization of the inner swellable element 130 and the outer swellable element 120 can allow the sealing member 100 to resist differential pressure.

Figure 3:
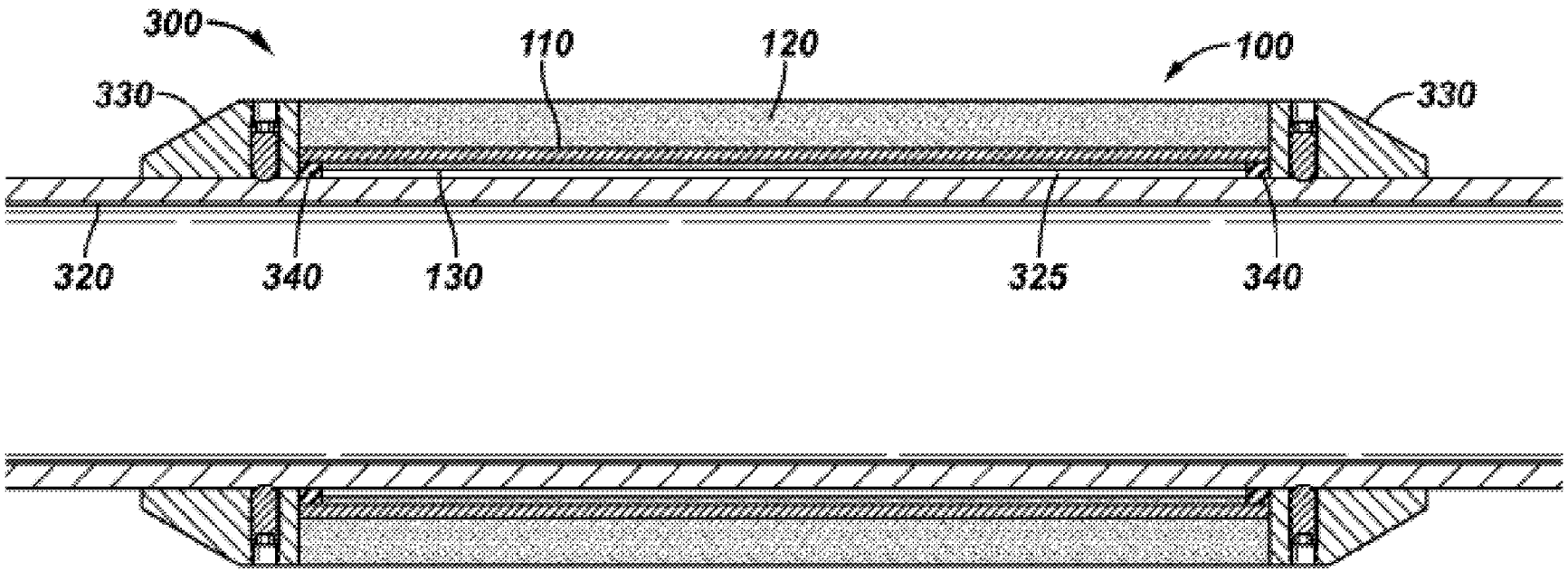
FIG. 3 is a schematic drawing of a swellable packer having an internal support tube.

FIG. 3 depicts a cross sectional view of an illustrative sealing member assembly 300, according to one or more embodiments as is shown in U.S. Published Patent Application No. 20090229816. The sealing member assembly 300 can include the sealing member 100 disposed about a tubular 320, according to one or more embodiments. The sealing member 100 can be disposed about the tubular 320 by locating the tubular 320 at least partially within the support member 110, forming an annulus 325 therebetween. The annulus 325 formed between the inner wall of the support member 110 and the tubular member 320 can be at least partially filed with the inner swellable element 130 in an unexpanded configuration. When the inner swellable element 130 is in an expanded configuration, the inner swellable element 130 can fill the annulus 325 and provide a seal between the tubular 320 and the support member 110. The tubular 320 can be used to connect to a wash pipe or other downhole instrument or equipment. For example, the tubular 320 can be threaded at one or both ends and can threadably connect to a completion assembly. It is possible that the tubular 320 can be configured to connect to other downhole instruments in other ways, such as with a snap latch.

The sealing member assembly 300 can further include two guide rings 330. The two guide rings 330 can be secured to the tubular 320, and the sealing member 100 can be disposed between the guide rings 330. The guide rings 330 can guide or control the radial expansion of the inner swellable element 130 and the outer swellable element 120 as the swellable elements 120, 130 radially expand. As used herein "radial" can include the direction perpendicular to the center line of a wellbore. The guide rings 330 can include solid rings, end rings, or other members configured to attach to the tubular 320. In one or more embodiments, the guide rings 330 can be or include a suitable bearing material, such as steel, stainless steel, or nickel alloys, depending on the well environment.

However, if modified as described below in FIGS. 4 and 5, larger maximum swellable diameters may be achievable.

Figure 2:
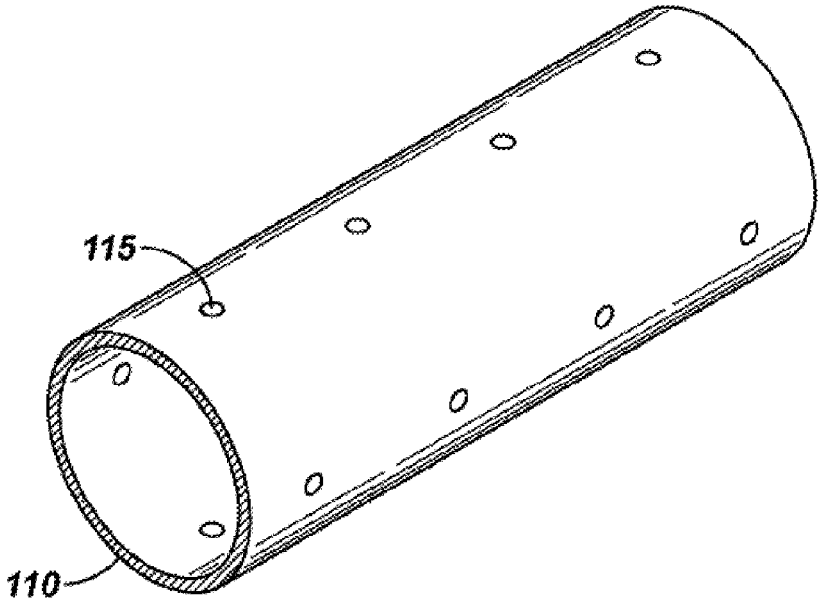
FIG. 2 is a schematic drawing of an internal swell packer support tube as disclosed in U.S. Published Patent Application No. 20090229816.
Figure 4:
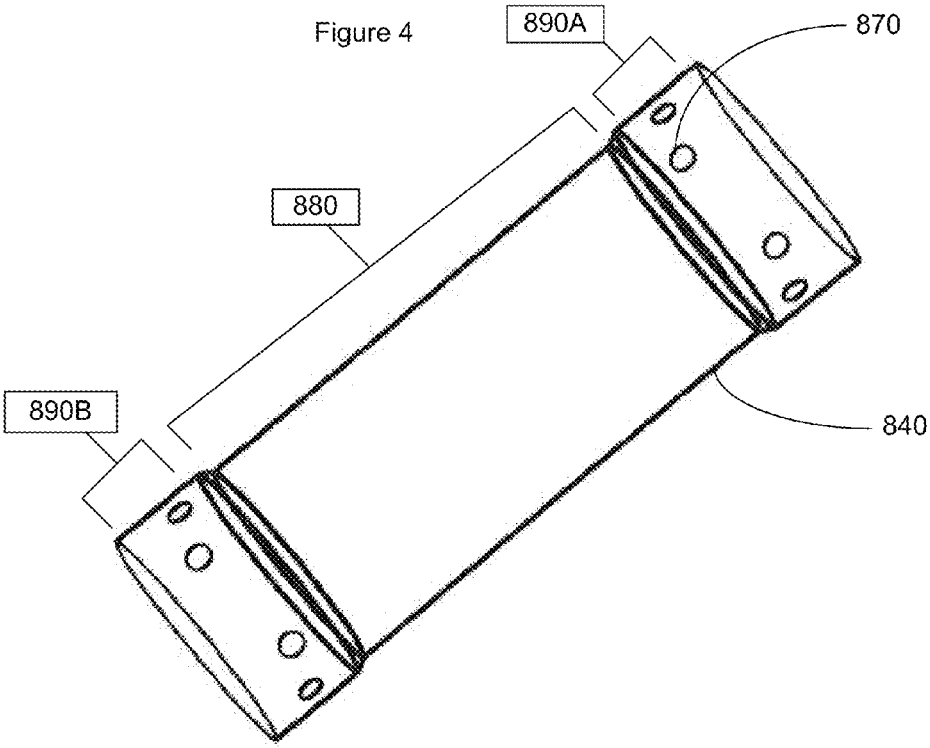
FIG. 4 is a schematic drawing of another swellable packer support tube.
Figure 5:
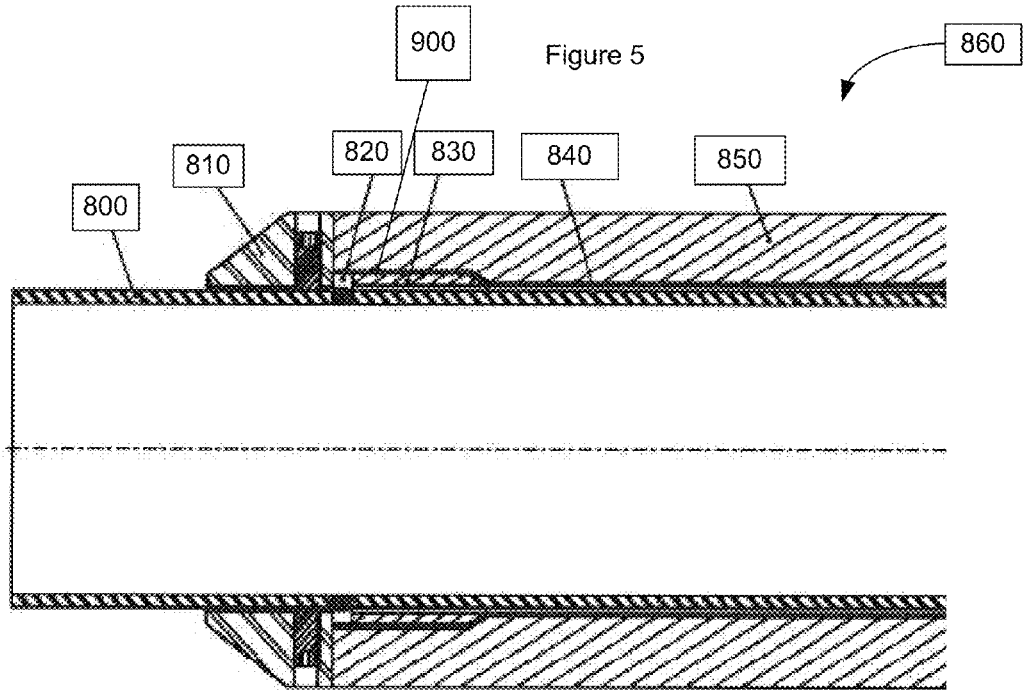
FIG. 5 is a schematic drawing of a swellable packer having another internal support tube.

As is shown in FIGS. 4 and 5, the support tube 840 is modified such that a portion of the support tube 880 is recessed relative to the outer surface of the swellable element 850. Similar to the support tube shown in FIG. 2, support tube 840 comprises apertures 870. However, in the support tube shown in FIG. 4, apertures 870 are preferably only present in the nonrecessed portions 890A and 890B of support tube 840.

As can be seen in FIG. 5, the support tube 840 preferably is offset from tubular 800 at the ends and substantially directly adjacent to base tubular 800 in the center. However, it is envisioned that the relative location of the offset portion 880 and the substantially adjacent portion (890A and 890B) may be moved. For example, a single offset portion may be located between two substantially adjacent portions.

FIG. 5 depicts a cross sectional view of the front portion of an illustrative sealing member assembly (i.e., packer) 860, according to one or more embodiments. It is preferred that the back portion of the packer (not shown) is identical to the front portion of the packer. The packer assembly 860 can include the sealing member 850 disposed about a tubular 800, according to one or more embodiments. The sealing member 850 can be disposed about the tubular 800 by locating the tubular 800 at least partially within the support member 840, forming at least one annulus 900 therebetween. The annulus 900 formed between the inner wall of the support member 840 and the tubular member 800 can be at least partially filled with the inner swellable element 830 in an unexpanded configuration. When the inner swellable element 830 is in an expanded configuration, the inner swellable element 830 may fill the annulus 900 and provide a seal between the tubular 800 and the support member 840. The tubular 800 can be used to connect to a wash pipe or other downhole instrument or equipment. For example, the tubular 800 can be threaded at one or both ends and can threadably connect to a completion assembly. It is possible that the tubular 800 can be configured to connect to other downhole instruments in other ways, such as with a snap latch.

The packer assembly 860 can further include two guide rings 810. The two guide rings 810 can be secured to the tubular 800, and the sealing member 850 can be disposed between the guide rings 810. The guide rings 810 can guide or control the radial expansion of the inner swellable element 830 and the outer swellable element 850 as the swellable elements 830, 850 radially expand. As used herein "radial" can include the direction perpendicular to the center line of a wellbore. The guide rings 810 can include solid rings, end rings, or other members configured to attach to the tubular 800. In one or more embodiments, the guide rings 810 can be or include a suitable bearing material, such as steel, stainless steel, or nickel alloys, depending on the well environment.

The swellable elements 830, 850 can be made by any swellable material. Illustrative swellable materials can be or include ethylene-propylene-copolymer rubber hydrocarbon oil, ethylene-propylene-diene terpolymer rubber hydrocarbon oil, butyl rubber hydrocarbon oil, halogenated butyl rubber hydrocarbon oil, brominated butyl rubber hydrocarbon oil, chlorinated butyl rubber hydrocarbon oil, chlorinated polyethylene hydrocarbon oil, starch-polyacrylate acid graft copolymer water, polyvinyl alcohol cyclic acid anhydride graft copolymer water, isobutylene maleic anhydride water, acrylic acid type polymers water, vinylacetate-acrylate copolymer water, polyethylene oxide polymers water, carboxymethyl celluclose type polymers water, starch-polyacrylonitrile graft copolymers water, highly swelling clay minerals (i.e. sodium bentonite) water, styrene butadiene hydrocarbon, ethylene propylene monomer rubber hydrocarbon, natural rubber hydrocarbon, ethylene propylene diene monomer rubber hydrocarbon, ethylene vinyl acetate rubber hydrocarbon, hydrogenised acrylonitrile-butadiene rubber hydrocarbon, acrylonitrile butadiene rubber hydrocarbon, isoprene rubber hydrocarbon, chloroprene rubber hydrocarbon, or polynorbornene hydrocarbon.

In one or more embodiments, the swellable elements 830, 850 can be disposed about the support member 840 by transfer molding. Transfer molding can include heating swellable material in a transfer pot, and disposing the support member 840 within a mold cavity. When the swellable material is heated to a temperature suitable for molding, the moldable swellable material is forced into the mold cavity. For example the moldable swellable material can be forced into the mold cavity by a ram or piston. The swellable material can be deposited or molded about the support member 840. As the swellable material is deposited on the exterior of the support member 840, the holes 870 allow the swellable material to flow therethrough disposing the swellable material about the inner portion of the support member 840. Accordingly, the inner swellable element 830 and the outer swellable element 850 can be disposed about the support member 840. The support member 840 can separate the inner swellable element 830 and the outer swellable element 850 and can provide support to the swellable elements 830, 850. Furthermore, since the inner swellable element 830 and outer swellable element 850 are disposed about the support member 840 in a single mold cycle the swellable elements 830, 850 are unitized with one another, while being separated from one another by the support member 840. After the swellable material is disposed about the support member 840, the mold cavity is closed and maintained at a temperature sufficient to allow the swellable material to cure. Once the swellable material is cured, the created sealing member is removed from the mold cavity.

Considering the support member in more detail, FIG. 4 depicts an isometric view of the support member 840. Any number of holes 870 can be formed through the support member 840. For example, the support member 840 can have one, two, three, four, five, ten, twenty, thirty, forty, fifty, sixty, one-hundred, or more holes 870 formed therethrough. The holes 870 can be formed through the support member 840 in any pattern. For example, the holes 870 can be arranged in a circumferential pattern about the support member 840. In one or more embodiments, the circumferential pattern can be from about twenty degrees to about one hundred and eighty degrees. The holes 870 can have an inner diameter ranging from about three eighths of an inch to about three inches. The holes 870 can allow the outer swellable element 830 and the inner swellable element 850 to unite with one another during transfer molding, compression molding, or injection molding.

The support member 840 can be configured to be disposed about a tubular or other circular member. The support member 840 can be aluminum, metal, or another material that is stiff enough to support the swellable elements 830, 850. The support member 840 can provide a stabilizing effect to the sealing member 850 by supporting the inner swellable element 830 and outer swellable element 850. In addition, the support member 840 can separate the inner swellable element 830 and the outer swellable element 850 from one another, while still allowing for unitization of the inner swellable element 830 and the outer swellable element 850.

One or more retainers or sealing devices 820 can be disposed or located at each end of the support member 840. In one or more embodiments, the retainers 820 can be integrated with the support member 840 during injection molding, compression molding, or transfer molding of the sealing member 850. The retainers 820 can be o-rings or other retainers that can seal about the tubular 800 and the support tube 840. The retainers 820 can prevent the inner swellable element 830 from extruding out of the support member 840. Furthermore, the retainers 820 can maintain the differential pressure within a wellbore. In one or more embodiments, the retainers 820 can be supported by metallic anti-extrusion rings (not shown) connected to the tubing 800. For example, the metallic anti-extrusion rings can be bonded to the tubing 800. In another embodiment, the retainer 820 can be made stiffer by the addition of directional reinforcements. The directional reinforcements can include chopped fibers, mats and long fibers of Kevlar, fiber glass and carbon fibers.

Figure 6:
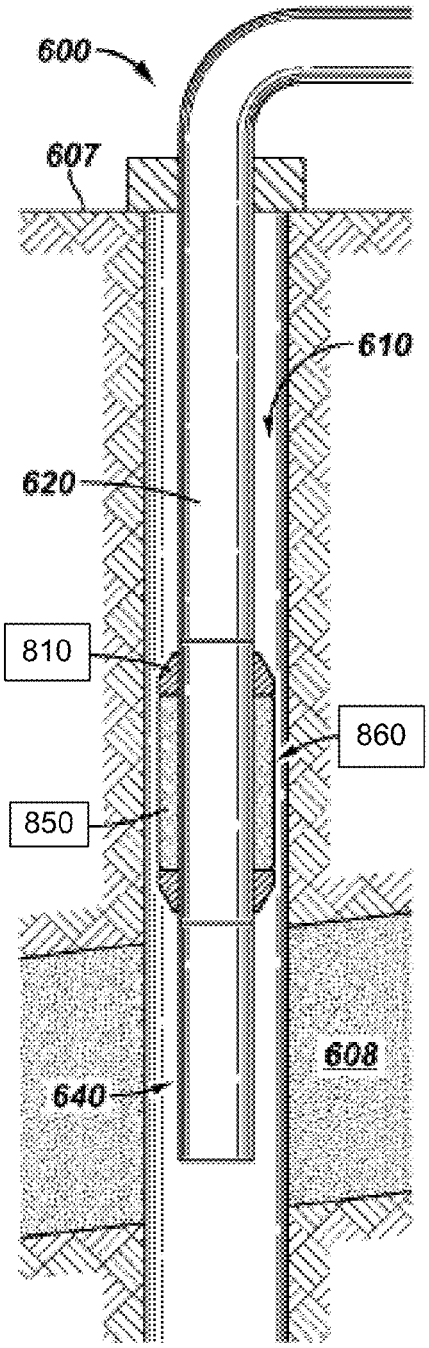
FIG. 6 is a schematic view of a sealing system in an original configuration located within a wellbore.
Figure 7:
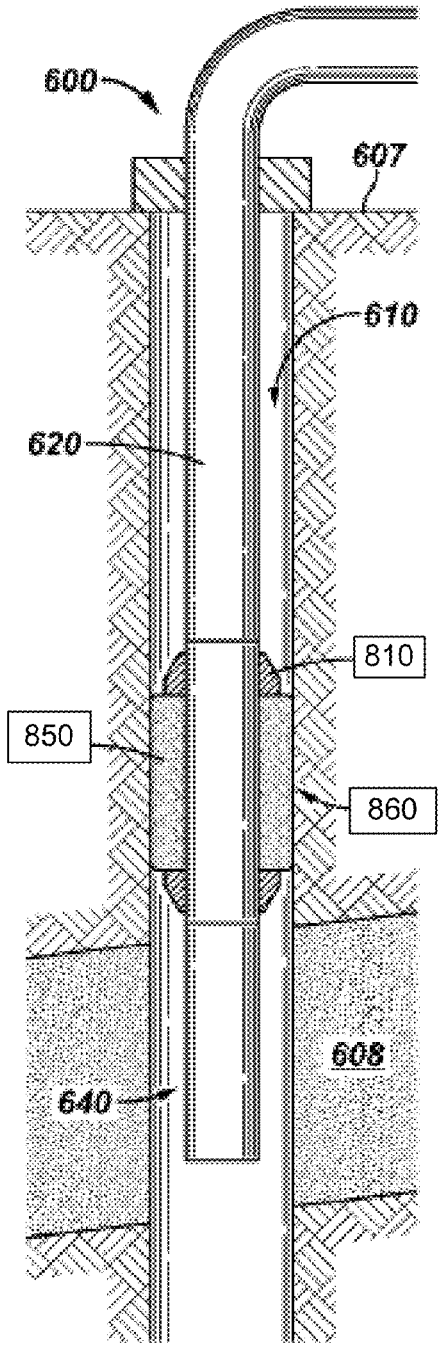
FIG. 7 is a schematic view of the sealing system of FIG. 6 in an expanded configuration located within the wellbore.

FIG. 6 depicts a schematic view of a completion system 600 in an original configuration within a wellbore 610, and FIG. 7 depicts a schematic view of the completion system 600 in an expanded configuration within the wellbore 610, according to one or more embodiments. Although not depicted, the completion system 600 can incorporate one or more packer assemblies. The completion system 600 as depicted can include one or more sealing member assemblies 860 connected to a production tubing or other downhole tubing 620. The production tubing 620 can provide fluid communication between the surface 607 and a hydrocarbon bearing zone 608. The production tubing 620 can be part of a conveying device for conveying the sealing member assembly 300 into the wellbore 610. The completion system 600 can further include a completion assembly 640 connected to the sealing member assembly 300. Accordingly, the sealing member assembly 300 can be disposed between the production tubing 620 and the completion assembly 640. The completion assembly 640 can be a sand completion assembly or other completion assembly for performing a downhole operation.

When the completion assembly 640 and the sealing assembly 300 are connected to the production tubing 620, the production tubing 620, the completion assembly 640, and the sealing assembly 860 can be conveyed into the wellbore 610. The completion assembly 640 can be located adjacent a hydrocarbon bearing zone 608. The sealing assembly 860 can be used to isolate the "upper" or first portion of the hydrocarbon bearing zone 608 from the "upper" or first portion of the wellbore 610. In one or more embodiments, a second sealing assembly 860 (not shown) can be connected to a "lower" or second end of the completion assembly 640 and can be used to isolate the "lower" or second portion of the hydrocarbon bearing zone 608 from the "lower" or second portion of the wellbore 610.

The swellable elements 830, 850 can be in an original or unexpanded state as the completion assembly 640 and sealing assembly 860 are conveyed into the wellbore 610, as depicted in FIG. 6. When the completion assembly 640 is located adjacent the hydrocarbon bearing zone 608, the sealing elements 830, 850 can be exposed to a trigger fluid. The trigger fluid can be wellbore fluid such as hydrocarbons, water, or other fluid naturally found in the wellbore 610 or the trigger fluid can be a fluid or chemical dropped into the wellbore 610 or injected into the wellbore 610. The trigger fluid used will depend on the material used to create the swellable elements 830, 850.

When the sealing member 850 is exposed to the trigger fluid, the swellable elements 830, 850 can expand. For example, the outer swellable element 830 can seal against the wall of the wellbore 610 and isolate the first portion of the hydrocarbon producing zone 608 from the first portion of the wellbore 610, and the inner swellable element 850 can expand providing a seal between the tubular 800 and the support member 840. As the swellable elements 830, 850 expand the guide rings 810 can guide or control the movement of the swellable elements 830, 850. The sealing devices 820 can prevent the inner swellable element 850 from extruding out of the support member 840. When the sealing assembly 860 is in an expanded state, as depicted in FIG. 7, production operations or other downhole operations can be executed.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

The invention claimed is:

1. A sealing system for use in a subterranean wellbore, the system comprising:

a tubular; and a sealing member assembly comprising:

at least two rings disposed about the tubular, wherein the rings are longitudinally spaced apart from one another, and wherein a sealing member is disposed between the rings, the sealing member comprising:

a support tube member disposed about the tubular, the support tube member comprising nonrecessed portions with a plurality of holes therethrough, wherein a nonrecessed portion of the support tube member is substantially directly adjacent the tubular and wherein first and second nonrecessed portions of the support tube member are located at an opposite end of the support tube member, wherein the support tube member comprises a recessed portion disposed between the nonrecessed portions;

an inner swellable element disposed interior of the support tube member;

an outer swellable element disposed about the exterior of the support tube member, wherein the inner and outer swellable elements are unitized with one another through at least a portion of the plurality of holes; and a retainer disposed at each end of the support tube member, wherein the retainers provide a seal between the ends of the support tube member and the tubular.

2. The packer of claim 1 wherein at least one of the inner and outer swellable element swells in the presence of an activating agent.

3. The packer of claim 2 wherein the activating agent is a hydrocarbon-based activating agent.

4. The packer of claim 2 wherein the activating agent is a water-based activating agent.

5. The method of claim 2 wherein the activating agent is water.

6. The packer of claim 1 wherein the recessed portion of the tubular support element does not have apertures therethrough.

7. The system of claim 1 wherein the holes have a size of from about ⅜ inch diameter to about 2 inch diameter.

8. A sealing system for use in a subterranean wellbore, the system comprising:

a tubular; and a sealing member assembly comprising:

at least two rings disposed about the tubular, wherein the rings are longitudinally spaced apart from one another, and wherein a sealing member is disposed between the rings, the sealing member comprising:

a support tube member disposed about the tubular, the support tube member comprising nonrecessed portions with a plurality of holes therethrough, wherein a nonrecessed portions of the support tube member is substantially directly adjacent the tubular and wherein first and second nonrecessed portions of the support tube member are located at an opposite end of the support tube member;

an inner swellable element disposed interior of the support tube member;

an outer swellable element disposed about the exterior of the support tube member, wherein the inner and outer swellable elements are unitized with one another through at least a portion of the plurality of holes; and a retainer disposed at each end of the support tube member, wherein the retainers provide a seal between the ends of the support tube member and the tubular, wherein the swellable element comprises an elastomer-based material.

* * * * *